US009239544B2

(12) United States Patent
Maeshima et al.

(10) Patent No.: US 9,239,544 B2
(45) Date of Patent: Jan. 19, 2016

(54) DEVELOPMENT APPARATUS, PROCESS CARTRIDGE, AND IMAGE FORMING APPARATUS

(71) Applicant: Canon Kabushiki Kaisha, Tokyo (JP)

(72) Inventors: Hideki Maeshima, Mishima (JP); Kuniaki Hirukawa, Susono (JP); Shuichi Gofuku, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/906,816

(22) Filed: May 31, 2013

(65) Prior Publication Data

US 2013/0322921 A1 Dec. 5, 2013

(30) Foreign Application Priority Data

Jun. 4, 2012 (JP) ..... 2012-127135

(51) Int. Cl.
*G03G 21/16* (2006.01)
*G03G 15/08* (2006.01)

(52) U.S. Cl.
CPC ..... *G03G 15/0881* (2013.01); *G03G 15/0817* (2013.01); *G03G 15/0898* (2013.01); *G03G 2215/0132* (2013.01)

(58) Field of Classification Search
USPC ..... 399/102, 103, 105, 111
See application file for complete search history.

(56) References Cited

U.S. PATENT DOCUMENTS

2011/0236058 A1* 9/2011 Nakajima ..... 399/103
2013/0051857 A1 2/2013 Itabashi

FOREIGN PATENT DOCUMENTS

JP 2006-208689 A 8/2006

* cited by examiner

*Primary Examiner* — Hoang Ngo
(74) *Attorney, Agent, or Firm* — Canon U.S.A., Inc. IP Division

(57) ABSTRACT

A development apparatus for an image forming apparatus includes a first sealing member provided in the supporting portion and configured to seal a gap between a peripheral surface of the development roller and the frame member at one end side of the frame member in the axis direction to prevent the developer from leaking from the frame member; and a second sealing member made of a resin and configured to seal the through hole, and the first sealing member, the supporting portion, and the second sealing member are arranged in this order on the same plane perpendicular to the axis direction.

38 Claims, 15 Drawing Sheets

DEVELOPMENT APPARATUS, PROCESS CARTRIDGE, AND IMAGE FORMING APPARATUS

BACKGROUND OF THE INVENTION

1. Field of the Invention

The present invention relates to an electrophotographic image forming apparatus.

2. Description of the Related Art

The electrophotographic image forming apparatus forms an image on a recording medium using an electrophotographic image forming method. Examples of the electrophotographic image forming apparatus include electrophotographic copying machines, electrophotographic printers (for example, laser beam printers and light-emitting diode (LED) printers), and facsimile apparatuses. Further, a process cartridge is formed by integrating an electrophotographic photosensitive drum and process units that act on the electrophotographic photosensitive drum, into a cartridge to be attachable to and detachable from an image forming apparatus main body. Examples of the process units include charging units, development units, and cleaning units that act on the electrophotographic photosensitive drum.

A development apparatus as the development unit included in the process cartridge mainly includes: a frame member accommodating a developer (hereinafter referred to as "toner"); a development roller placed in an opening portion of the frame member; a supply roller that supplies the toner to the development roller; and a developer regulating member that regulates the thickness of the toner on the development roller.

In the development apparatus having such a configuration, to prevent the toner from flowing out of the opening portion of the frame member, end sealing members (sealing members) are generally provided between respective longitudinal end portions of the development roller and the frame member. The end sealing members are supported being attached to supporting portions of the frame member, and seal the toner by abutting the surface of the development roller in the respective longitudinal end portions thereof. Japanese Patent Application Laid-Open No. 2006-208689 (p. 21, FIGS. 8A and 8B) discusses a method of mounting a supply roller to a frame member by moving the supply roller in an axis direction of the supply roller. In Japanese Patent Application Laid-Open No. 2006-208689 (p. 21, FIGS. 8A and 8B), a through hole is formed on a side surface of the frame member, so that the supply roller is inserted through the through hole in the axis direction of the supply roller, thereby mounting the supply roller to the frame member.

The case is considered where, in the configuration where a through hole is provided to allow the insertion of a supply roller into a frame member accommodating a developer as in the above conventional art, a sealing member is provided between an end portion of a development roller and the frame member. If the sealing member and a supporting portion for supporting the sealing member are located between the development roller and the through hole, the supporting portion may be subjected to the pressure from the development roller through the sealing member and may deform. The deformation of the supporting portion reduces the sealing performance of the sealing member.

SUMMARY OF THE INVENTION

The present invention is directed to providing a development apparatus that suppresses the deformation of a supporting portion for supporting a sealing member.

According to an aspect of the present invention, a development apparatus for an image forming apparatus includes a development roller configured to develop, using a developer, an electrostatic latent image formed on an image bearing body; a frame member accommodating the developer and having a through hole and a supporting portion at one end side of said frame member in an axis direction of the development roller; a supply roller attached to the frame member passing through the through hole and configured to supply the developer to the development roller; a first sealing member provided in the supporting portion and configured to seal a gap between a peripheral surface of the development roller and the frame member at one end side of said frame member in the axis direction to prevent the developer from leaking from the frame member; and a second sealing member made of a resin and configured to seal the through hole, wherein the first sealing member, the supporting portion, and the second sealing member are arranged in this order on the same plane perpendicular to the axis direction.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
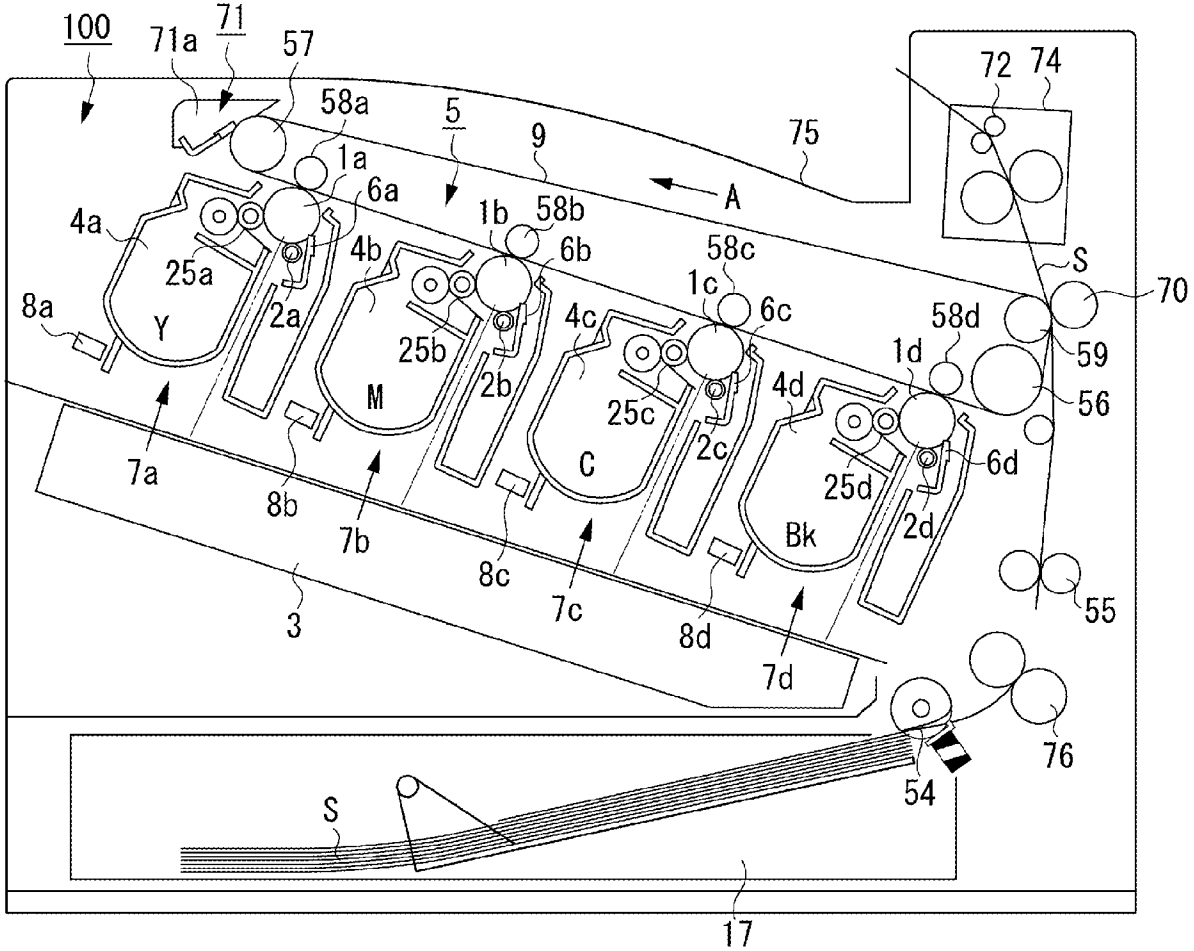
FIG. 1 is a diagram illustrating the configuration of an electrophotographic image forming apparatus according to an exemplary embodiment of the present invention.

A process cartridge and a color electrophotographic image forming apparatus according to an exemplary embodiment of the present invention are described. FIG. 1 is a diagram illustrating the overall configuration of the color electrophotographic image forming apparatus according to the present exemplary embodiment.

(Overall Configuration of Image Forming Apparatus)

With reference to FIG. 1, the overall configuration of the image forming apparatus is described. An image forming apparatus 100 illustrated in FIG. 1 has four process cartridge mounting portions (not illustrated). FIG. 1 illustrates four image forming stations, namely first to fourth image forming stations Y, M, C, and Bk, for forming images using yellow, magenta, cyan, and black developers (hereinafter referred to as "toner"), respectively, corresponding to the color separation components of a full-color image. The image forming stations Y, M, C, and Bk are placed side by side within the apparatus main body 100 so as to be inclined relative to the horizontal direction.

In each of the image forming stations Y, M, C, and Bk, electrophotographic process units are placed around an electrophotographic photosensitive drum 1 (1*a*, 1*b*, 1*c*, 1*d*) serving as an image bearing body. The electrophotographic process units include: a charging roller 2 (2*a*, 2*b*, 2*c*, 2*d*) that uniformly charges the surface of the photosensitive drum 1; a development roller 25 (25*a*, 25*b*, 25*c*, 25*d*) that develops and visualizes, using toner, a latent image formed on the photosensitive drum 1; and a cleaning member 6 (6*a*, 6*b*, 6*c*, 6*d*) that removes the toner remaining on the photosensitive drum 1 after the toner image formed on the photosensitive drum 1 is transferred onto a recording medium. It should be noted that, as will be described later, the photosensitive drum 1, the charging roller 2, the development roller 25, and the cleaning member 6 are provided in a process cartridge 7 (7*a*, 7*b*, 7*c*, 7*d*) in an integrated manner, attachable to and detachable from the apparatus main body 100.

Additionally, below the process cartridges 7*a*, 7*b*, 7*c*, and 7*d* a scanner unit 3 is provided attached to the image forming apparatus main body 100, to perform a selective exposure on the photosensitive drums 1*a*, 1*b*, 1*c*, and 1*d* based on image information, thereby forming latent images on the respective photosensitive drums 1*a*, 1*b*, 1*c*, and 1*d*.

On a lower portion of the apparatus main body 100, a cassette 17 accommodating recording media S is mounted. Further, a recording medium conveying unit is provided to convey the recording media S to an upper portion of the apparatus main body 100 through the positions of the photosensitive drums 1*a*, 1*b*, 1*c*, and 1*d*. That is, a feed roller 54, a pair of conveyance rollers 76, and a pair of registration rollers 55 are provided. The feed roller 54 separates and feeds the recording media S in the cassette 17 one by one. The pair of conveyance rollers 76 conveys the fed recording medium S. The pair of registration rollers 55 synchronizes the recording medium S with latent images to be formed on the respective photosensitive drums 1*a*, 1*b*, 1*c*, and 1*d*. Further, above the process cartridges 7*a*, 7*b*, 7*c*, and 7*d*, an intermediate transfer unit 5 is provided as an intermediate transfer unit configured to transfer toner images formed on the respective photosensitive drums 1*a*, 1*b*, 1*c*, and 1*d*. The intermediate transfer unit 5 has a driving roller 56, a driven roller 57, a primary transfer roller 58 (58*a*, 58*b*, 58*c*, 58*d*) at a position opposed to the photosensitive drum 1 of the corresponding color, and a counter roller 59 at a position opposed to a secondary transfer roller 70, and a transfer belt 9 is stretched around these rollers. Then, the transfer belt 9 circularly moves while being opposed to and in contact with all the photosensitive drums 1*a*, 1*b*, 1*c*, and 1*d*, and voltage is applied to the primary transfer roller 58 (58*a*, 58*b*, 58*c*, 58*d*), thereby primarily transferring a toner image from the photosensitive drum 1 onto the transfer belt 9. Then, voltage is applied to the counter roller 59, placed within the transfer belt 9, and the secondary transfer roller 70, thereby transferring the toner on the transfer belt 9 onto a recording medium S.

Image formation is performed by rotating the photosensitive drum 1 and causing the scanner unit 3 to perform a selective exposure on the photosensitive drum 1 uniformly charged by the charging roller 2. This forms an electrostatic latent image on the photosensitive drum 1. The development roller 25 develops the latent image. This forms a toner image of each color on the corresponding photosensitive drum 1. In synchronization with the image formation, the pair of registration rollers 55 conveys a recording medium S to a secondary transfer position where the counter roller 59 and the secondary transfer roller 70 abut each other through the transfer belt 9. Then, transfer bias voltage is applied to the secondary transfer roller 70, thereby secondarily transferring the toner images of the respective colors on the transfer belt 9 onto the recording medium S. This forms a color image on the recording medium S. The recording medium S on which the color image has been formed as described above is heated and pressed by a fixing unit 74 to fix the toner images. Thereafter, the recording medium S is discharged to a discharge portion 75 by a discharge roller 72. It should be noted that the fixing unit 74 is placed in an upper portion of the apparatus main body 100.

(Process Cartridge)

Figure 3:
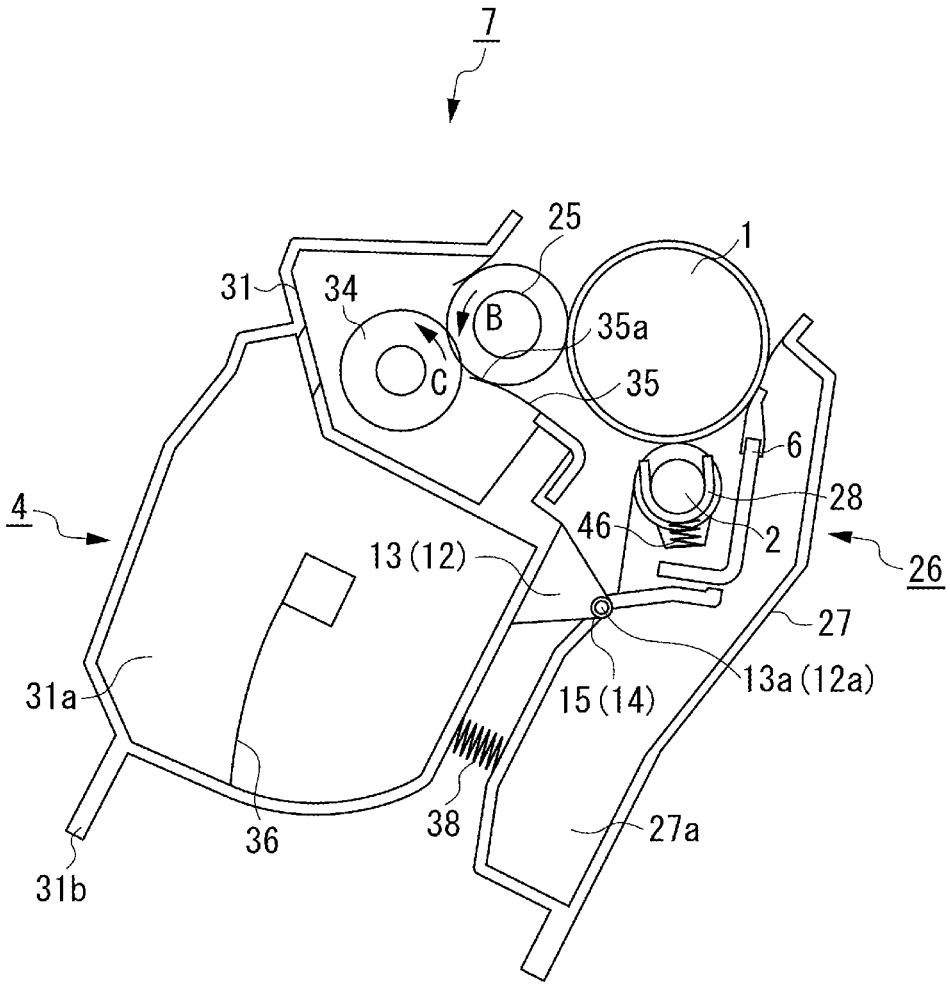
FIG. 3 is a cross-sectional view of a process cartridge according to the exemplary embodiment of the present invention.

Next, the process cartridge for carrying out the present invention is described. FIG. 3 is the principal section of the process cartridge 7 accommodating a developer (hereinafter referred to as "toner"). It should be noted that the cartridge 7*a* accommodating yellow toner, the cartridge 7*b* accommodating magenta toner, the cartridge 7*c* accommodating cyan toner, and the cartridge 7*d* accommodating black toner have similar configurations.

The process cartridge 7 (7*a*, 7*b*, 7*c*, 7*d*) includes: a cleaning unit 26 (26*a*, 26*b*, 26*c*, 26*d*) having the photosensitive drum 1 (1*a*, 1*b*, 1*c*, 1*d*), the charging roller 2 (2*a*, 2*b*, 2*c*, 2*d*), and the cleaning member 6 (6*a*, 6*b*, 6*c*, 6*d*); and a development unit 4 (4*a*, 4*b*, 4*c*, 4*d*) as a development apparatus having a development roller.

Figure 4:
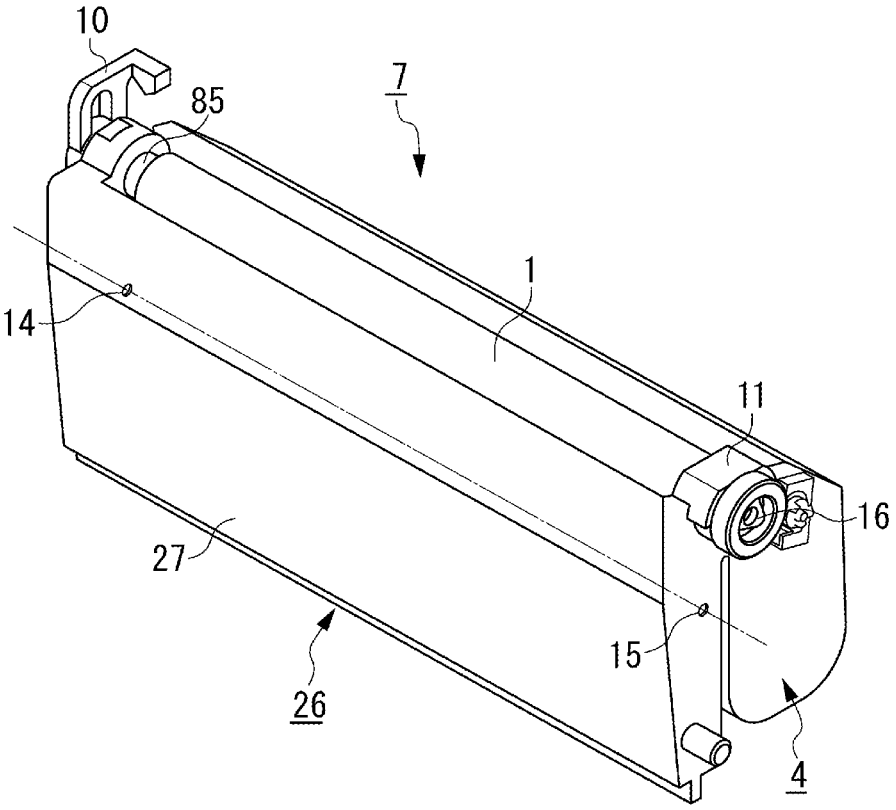
FIG. 4 is an external perspective view of the process cartridge according to the exemplary embodiment of the present invention.

The photosensitive drum 1 is rotatably attached to a cleaning frame member 27 of the cleaning unit 26 through a drum-front bearing 10 and a drum-rear bearing 11 (see FIG. 4). On the periphery of the photosensitive drum 1, the charging roller 2 and the cleaning member 6 are placed as described above.

Further, the residual toner removed from the surface of the photosensitive drum 1 by the cleaning member falls into a removed toner chamber 27*a*. Then, the driving force of a main body driving motor (not illustrated) is transmitted to the cleaning unit 26, thereby driving the photosensitive drum 1 to rotate according to an image forming operation. The charging roller 2 is rotatably attached to the cleaning frame member through a charging roller bearing 28. The charging roller 2 is pressed toward the photosensitive drum 1 by a charging roller pressing member 46 and is driven to rotate by the photosensitive drum 1.

Figure 5:
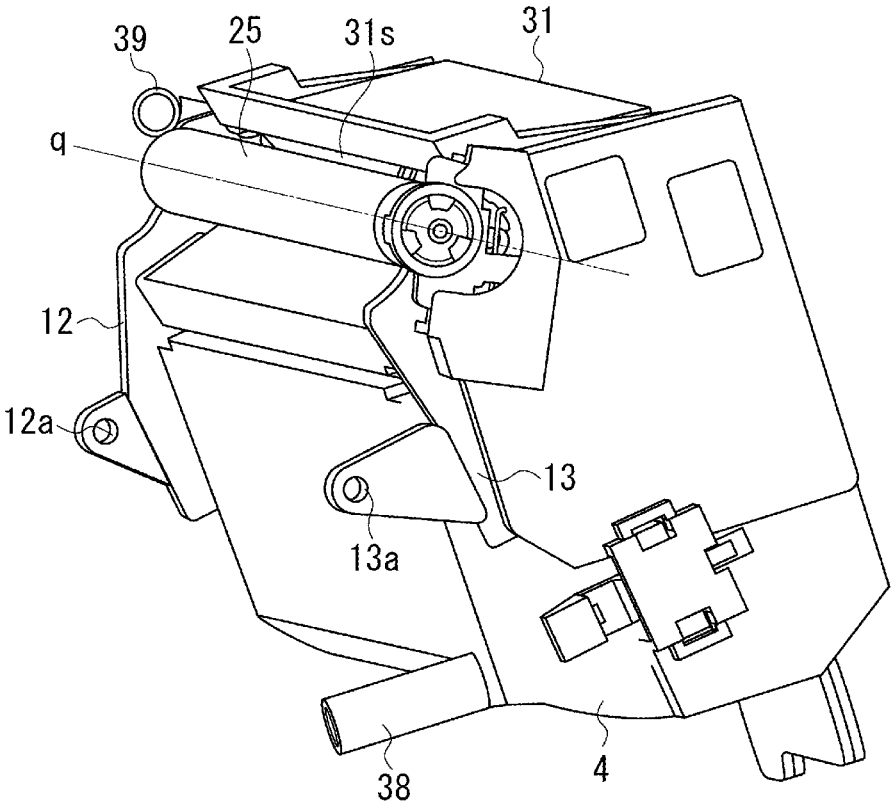
FIG. 5 is a perspective view of the development unit according to the exemplary embodiment of the present invention.

The development unit 4 mainly includes a development frame member 31, the development roller 25, a toner supply roller 34, a development blade 35, and a toner conveying member 36. The development frame member 31 accommodates toner. As illustrated in FIG. 5, the development roller 25 is rotatably supported by the development frame member 31 through a development-front bearing 12 and a development-rear bearing 13 that are attached to respective ends of the development frame member 31, and the development roller 25 is placed in an opening portion 31*s* of the development frame member 31. The development roller 25 bears the toner on its peripheral surface and is placed in contact with the photosensitive drum 1. Then, the development roller 25 rotates about a development roller axis q (see FIG. 5) in the direction of an arrow B in FIG. 3 and develops an electrostatic latent image formed on the photosensitive drum 1 to form a toner image. The toner supply roller 34 has a urethane foam layer on its surface and has a supply roller shaft 34*h* as a rotating shaft member. The toner supply roller 34 rotates in the direction of an arrow C in FIG. 3 in contact with the development roller 25 and supplies the toner to the development roller 25. The development blade 35 regulates the thicknesses of the toner layers on the toner supply roller 34 and the development roller 25. The toner conveying member 36 is provided in a toner accommodating portion 31*a* of the development frame member 31 to agitate the accommodated toner and also convey the toner to the toner supply roller 34.

FIG. 4 is an external perspective view of the process cartridge 7. The development unit 4 is attached to the cleaning unit 26 so as to be rotatable relative to the cleaning unit 26. The development unit 4 is supported so as to be rotatable relative to the cleaning frame member 27 (see FIGS. 3 and 4) by engaging a front supporting pin 14 and a rear supporting pin 15 with suspension holes 12*a* and 13*a* (see FIG. 5) of the development-front bearing 12 and the development-rear bearing 13, respectively. The front supporting pin 14 and the rear supporting pin 15 are press-fitted to the cleaning frame member 27. Further, in the cleaning frame member 27, the drum-front bearing 10 and the drum-rear bearing 11 are provided to rotatably support the photosensitive drum 1. Then, the drum-rear bearing 11 supports a drum coupling 16, which is combined with the electrophotographic photosensitive drum 1 to transmit the driving force of the image forming apparatus main body 100 to the photosensitive drum 1.

Additionally, the development unit 4 illustrated in FIG. 5 is configured to be urged toward the cleaning unit 26 by a pressure spring 38 provided in the development frame member 31 and a tension spring 39 provided in the development-front bearing 12 during the image formation of the process cartridge 7. These springs generate a pressure force for bringing the development roller 25 into contact with the photosensitive drum 1 such that the holes 12*a* and 13*a* of the development-front bearing 12 and the development-rear bearing 13 are the center of rotational movement.

It should be noted that in a contact development method for bringing the photosensitive drum 1 and the development roller 25 into contact with each other to develop an image, the photosensitive drum 1 is desirably a rigid body, and the development roller 25 is a roller having an elastic body. As the elastic body, for example, a solid rubber monolayer or a solid rubber coated with a resin is used in consideration of the toner charging performance.

Next, a series of operations regarding the image formation of the process cartridge are described (see FIGS. 1 and 3). When image information has been sent to the image forming apparatus 100, the main body driving motor (not illustrated) starts rotating and transmits drive to the photosensitive drum 1. Then, the image forming apparatus main body 100 applies charging bias voltage to the charging roller 2 to uniformly charge the surface of the photosensitive drum 1. Then, the scanner unit 3 performs an exposure according to the image information to form a latent image on the photosensitive drum 1.

Then, the developer conveying mechanism 36 feeds the toner in the development frame member 31 to the toner supply roller 34. Then, the toner supply roller 34 supplies the toner to the outer periphery of the development roller 25. The development blade 35 frictionally charges the supplied toner on the outer periphery of the development roller 25. Then, the apparatus main body 100 applies development bias voltage to the development roller 25, thereby developing the electrostatic latent image formed on the electrophotographic photosensitive drum 1. It should be noted that the development roller 25 is placed so as to be opposed to the photosensitive drum 1. The development roller 25 is configured to come into contact with the photosensitive drum 1 to develop the electrostatic latent image formed on the photosensitive drum 1.

(Configuration of Development Unit)

The configuration of the development unit according to the present exemplary embodiment is described.

Figure 6:
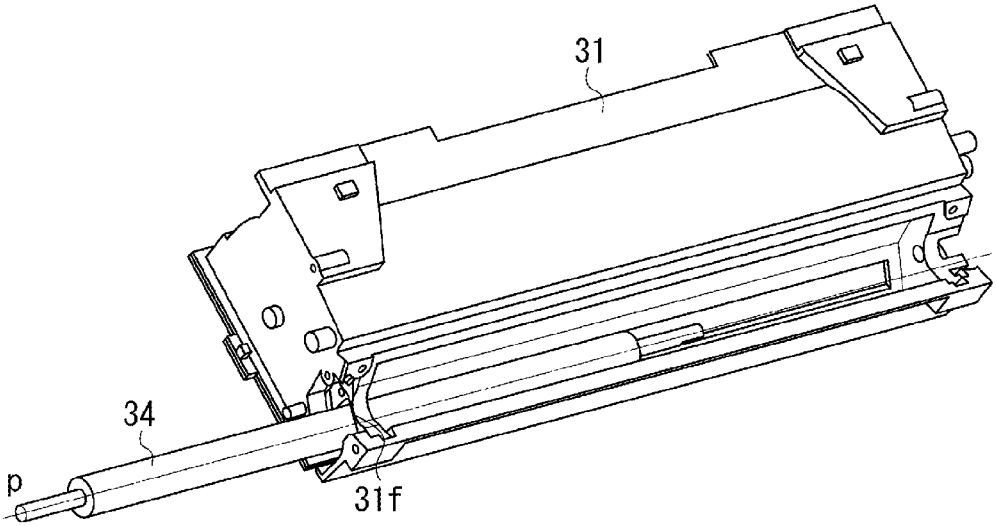
FIG. 6 is a perspective view of the process of assembling the development unit according to the exemplary embodiment.
Figure 7:
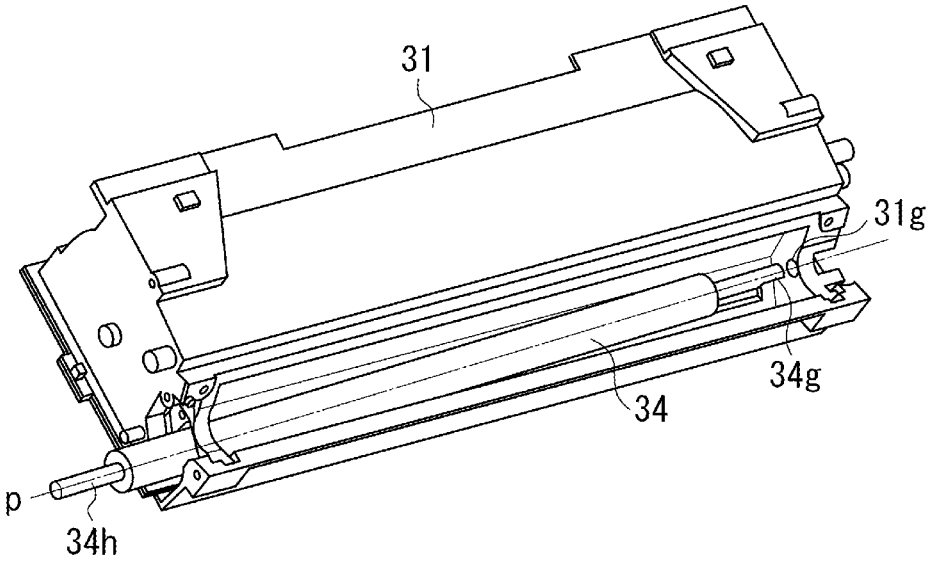
FIG. 7 is a perspective view of the process of assembling the development unit according to the exemplary embodiment.
Figure 11:
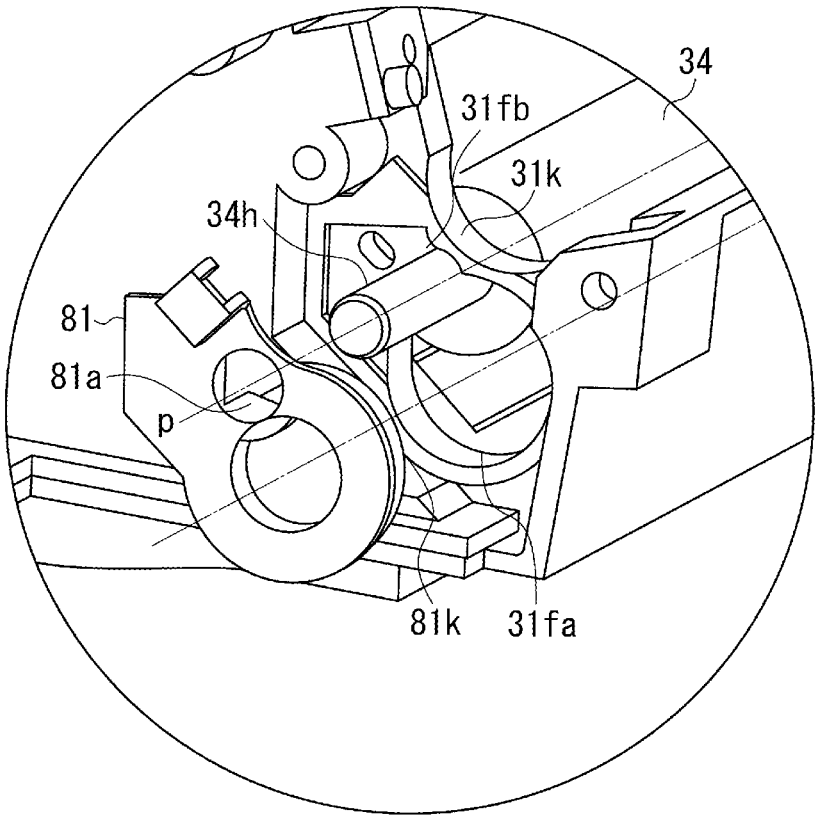
FIG. 11 is a detailed perspective view of the process of assembling the development unit according to the exemplary embodiment.
Figure 15:
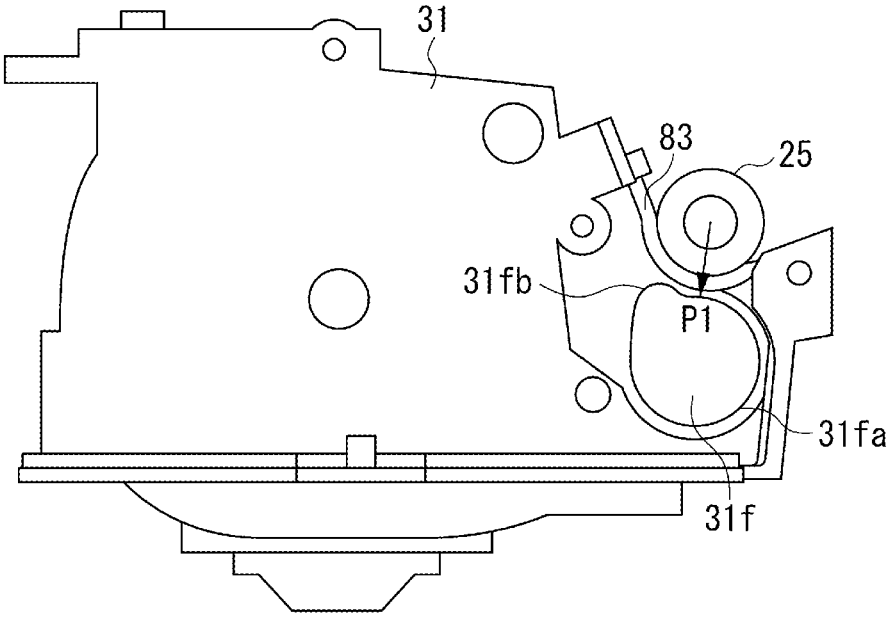
FIG. 15 is a side view of the development unit according to the exemplary embodiment.

As illustrated in FIGS. 6 and 11, the development frame member 31 has a through hole 31*f* on the surface at one end side of the development frame member 31. The through hole 31*f* is formed to allow the insertion of the supply roller 34 into the development frame member 31 from the outside thereof in the direction of a supply roller axis p. Further, as illustrated in FIG. 15, the through hole 31*f* has an insertion hole 31*fa* (an insertion portion) into which the supply roller 34 is to be inserted, and a first guide hole 31*fb* (a guide portion) for guiding the supply roller shaft 34*h*. The insertion hole 31*fa* is formed to have a diameter greater than the maximum outer diameter of the supply roller 34 (that is, a cross section of the through hole 31*f* perpendicular to the supply roller axis p is greater than a cross section of the supply roller 34 perpendicular to the supply roller axis p), thereby facilitating the insertion of the supply roller 34. Thus, it is possible to suppress the friction between the supply roller 34 and the inner surface of the insertion hole 31*fa* when the supply roller 34 is inserted into the insertion hole 31*fa*. This enables the suppression of the damage of the supply roller 34. During the process of inserting the supply roller 34 into the development frame member 31, a supply roller shaft 34*g* is inserted into a second guide hole 31*g* provided at the other longitudinal end of the development frame member 31 (see FIG. 7).

Figure 8:
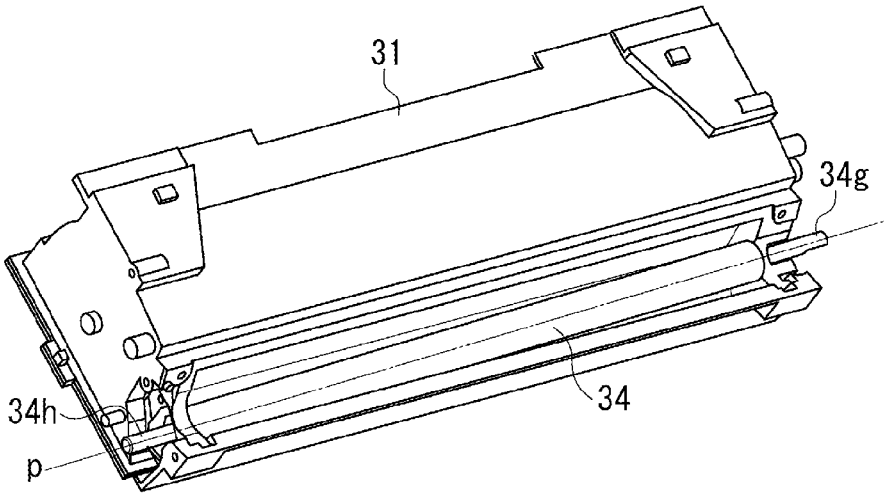
FIG. 8 is a perspective view of the process of assembling the development unit according to the exemplary embodiment.
Figure 9:
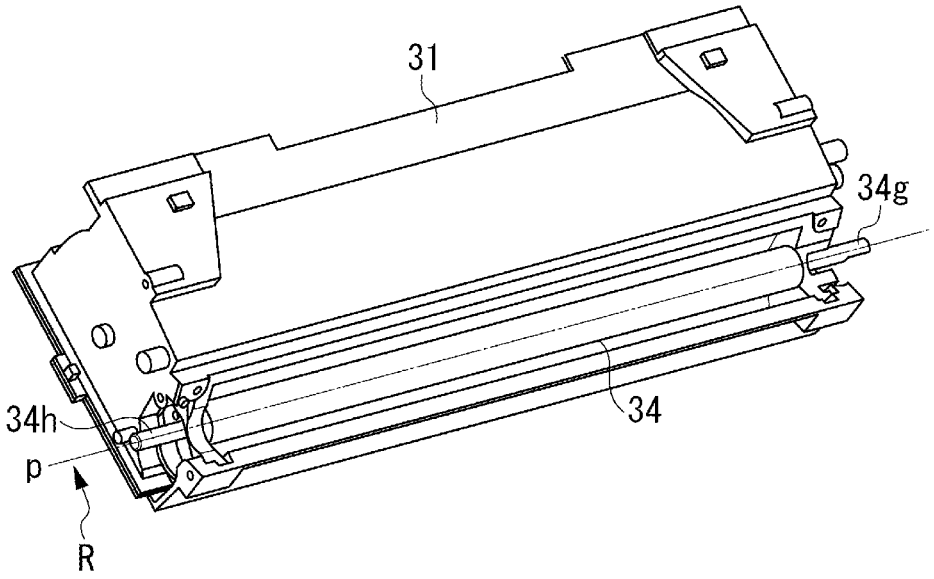
FIG. 9 is a perspective view of the process of assembling the development unit according to the exemplary embodiment.

The insertion hole 31*fa* and the first guide hole 31*fb*, which are provided at one end side of the development frame member 31, are connected together to allow the movement of the supply roller 34. After the supply roller 34 is inserted in the axis direction of the supply roller 34, as illustrated in FIGS. 8 and 9, the supply roller shaft 34*h* is moved from the position of the insertion hole 31*fa* (see FIG. 8) to the position of the first guide hole 31*fb* (in a direction R in FIG. 9), and the supply roller 34 is held.

Figure 10:
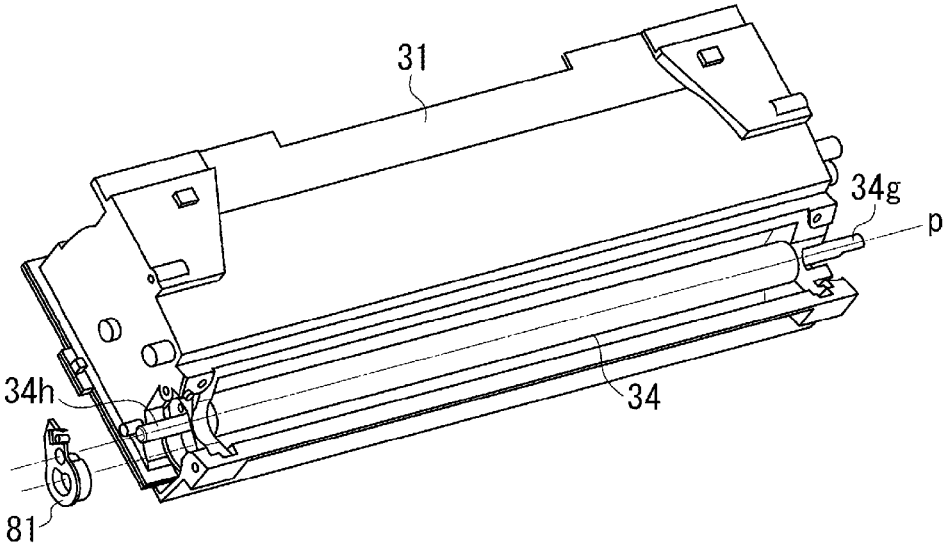
FIG. 10 is a perspective view of the process of assembling the development unit according to the exemplary embodiment.
Figure 12:
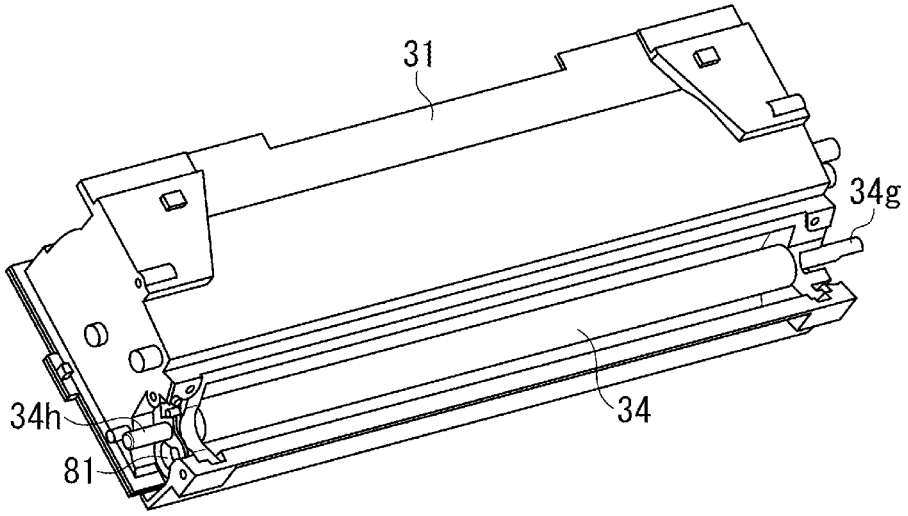
FIG. 12 is a perspective view of the process of assembling the development unit according to the exemplary embodiment.

Thereafter, as illustrated in FIGS. 10 to 12, a bush member 81 as a second sealing member for sealing the through hole

31*f* is assembled to the development frame member 31, so that the first guide hole 31*fb* provided in the development frame member 31 and a third guide hole 81*a* provided in the bush member 81 (see FIG. 11) guide and hold the supply roller shaft 34*h*.

Here, in the present exemplary embodiment, the bush member 81 is made of polystyrene. The bush member 81 increases the stiffness of the development frame member 31 around the insertion hole 31*fa* by fitting the insertion hole 31*fa* provided in the development frame member 31 (see FIG. 2A). An end sealing member 83 is pasted to a supporting portion 31*k* of the development frame member 31 and supported. The development roller 25 is assembled to the development frame member 31 so as to abut the end sealing member 83. The end sealing member 83 functions as a first sealing member for sealing the gap between the peripheral surface of the development roller 25 and the supporting portion 31*k* of the frame member 31 in at one end side of said frame member 31 in the axis direction of the development roller 25.

Figure 2A:
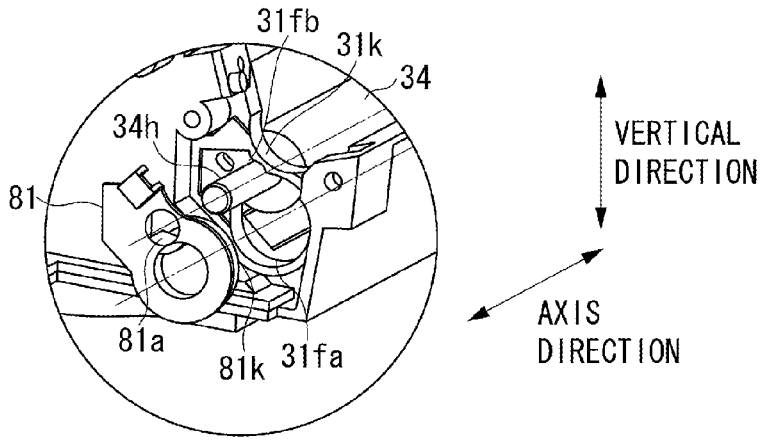
FIG. 2A is a detailed diagram illustrating an end portion of a development unit according to the exemplary embodiment of the present invention.
Figure 2B:
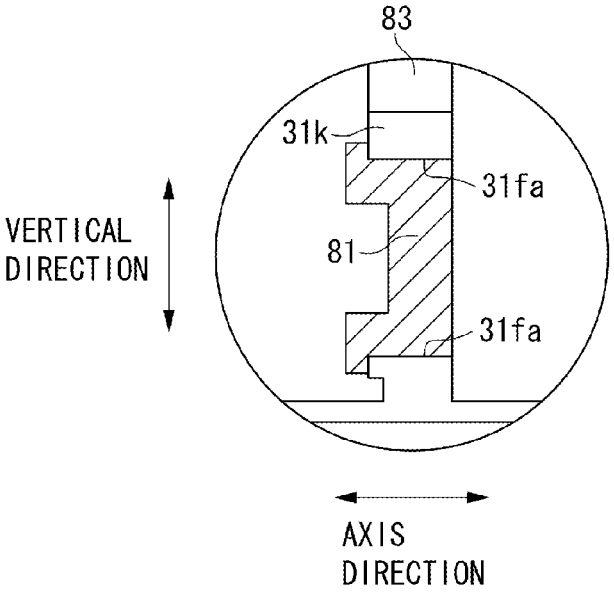
FIG. 2B is a cross-sectional view of the end portion.
Figure 13:
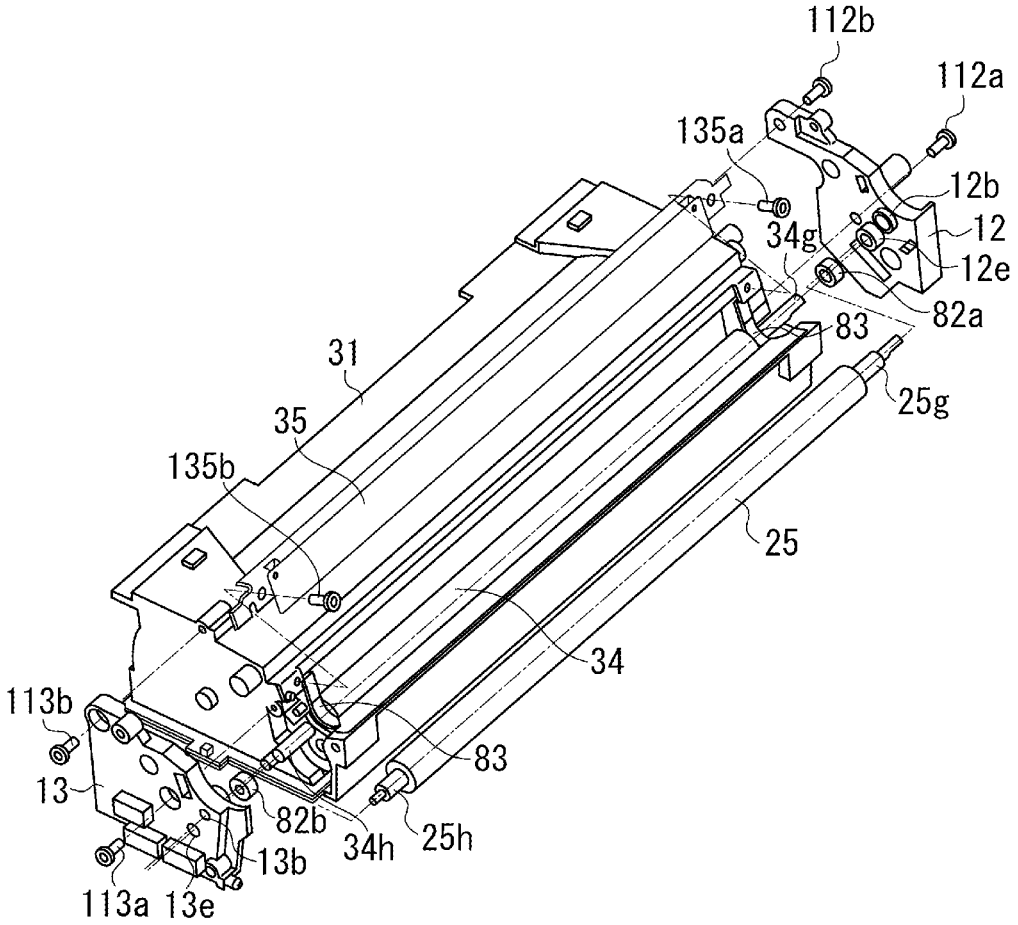
FIG. 13 is a perspective view of the process of assembling the development unit according to the exemplary embodiment.
Figure 14:
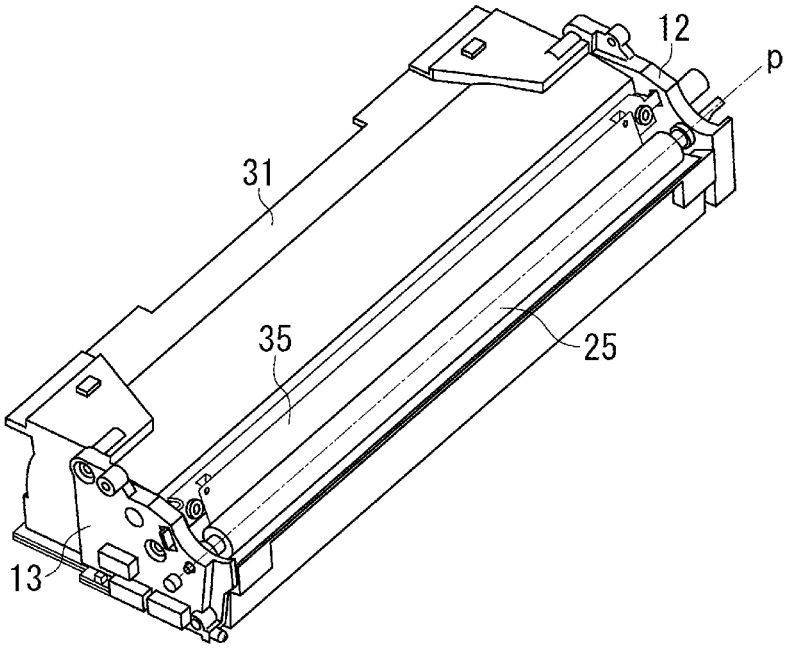
FIG. 14 is a perspective view of the process of assembling the development unit according to the exemplary embodiment.

As illustrated in FIGS. 13 and 14, the development roller 25 and the development frame member 31 are positioned by the bearing members (12 and 13). Here, the end sealing member 83 and the supporting portion 31*k* are located between the development roller 25 and the through hole 31*f*, so that the end sealing member 83 is compressively held by the development roller 25 and the supporting portion 31*k*. Thus, a force P1 generated by the development roller 25 abutting the end sealing member 83 is applied to the supporting portion 31*k* of the development frame member 31 (see FIG. 15). In the present invention, to prevent the supporting portion 31*k* from deforming (to prevent the through hole 31*f* from deforming) by the force P1, as illustrated in FIG. 2A, the bush member 81 fits the insertion hole 31*fa* of the development frame member 31. FIG. 2B is a cross-sectional view of a bush member fitting portion in a state where the end sealing member 83 is pasted to the supporting portion 31*k* in FIG. 2A (a cross-sectional view in a vertical plane passing through the center of the insertion hole 31*f* and parallel to the supply roller axis p). As illustrated in FIG. 2B, the bush member 81 fits the insertion hole 31*fa* to support the back surface of the supporting portion 31*k* (a part of the inner surface of the through hole 31*f*). Then, the end sealing member 83 and the bush member 81 are provided so as to be located on the same plane perpendicular to the direction of the development roller axis q. With this configuration, it is possible to suppress the deformation of the supporting portion 31*k* under the influence of the force P1.

It should be noted that in the present exemplary embodiment, as illustrated in FIG. 2B, the bush member 81 is provided from one end to the other end of the through hole 31*f* in the direction of the development roller axis q to support the back surface of the supporting portion 31*k*. With this configuration, it is possible to suppress the deformation of the supporting portion 31*k* of the development frame member 31 more effectively.

Additionally, in the present exemplary embodiment, the bush member 81 is made of polystyrene. To seal the through hole 31*f* and also suppress the deformation of the supporting portion 31*k*, it is desirable that the material of the bush member 81 should be a thermoplastic material such as polycarbonate, polypropylene, or an acrylonitrile-butadiene-styrene (ABS) resin. In particular, to suppress the deformation of the supporting portion 31*k*, it is desirable that the material should have a tensile strength of 20 MPa or more (JIS K7113).

Additionally, in the present exemplary embodiment, the tensile strength (JIS g0202) of each of the rotating shafts 34*g* and 34*h* of the supply roller 34 is greater than the tensile strength of the bush member 81, and as illustrated in FIG. 2A, the rotating shaft 34*h* of the supply roller 34 is placed at a position opposed to the back surface of the supporting portion 31*k*. This enables not only the bush member 81 but also the rotating shaft 34*h* of the supply roller 34 to contribute to suppressing the deformation of the supporting portion 31*k* when the supporting portion 31*k* is subjected to the force P1. Thus, it is possible to suppress the deformation of the supporting portion 31*k* more effectively.

It should be noted that in the present exemplary embodiment, the development roller axis q is parallel to the supply roller axis p, and "the axis direction of the supply roller" represents the same direction as "the axis direction of the development roller". Further, in the present exemplary embodiment, the rotating shafts 34*g* and 34*h* of the supply roller 34 are designated by different numerals for convenience, but represent the same member.

Based on the exemplary embodiment of the present invention, in the configuration where a through hole is provided to allow the insertion of a supply roller into a frame member accommodating a developer, and a sealing member is provided between an end portion of a development roller and the frame member, it is possible to suppress the deformation of a supporting portion for supporting the sealing member.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-127135 filed Jun. 4, 2012, which is hereby incorporated by reference herein in its entirety.

What is claimed is:

1. A development apparatus for an image forming apparatus, the development apparatus comprising:

a development roller configured to develop, using a developer, an electrostatic latent image formed on an image bearing body;

a frame member accommodating the developer and having a through hole and a supporting portion at one end side of the frame member in an axis direction of the development roller;

a supply roller attached to the frame member through the through hole and configured to supply the developer to the development roller;

a first sealing member provided in the supporting portion and configured to seal a gap between a peripheral surface of the development roller and the frame member at one end side of the frame member in the axis direction to prevent the developer from leaking from the frame member; and a second sealing member made of a resin and configured to seal the through hole, wherein the first sealing member, the supporting portion, and the second sealing member are arranged in this order on the same plane perpendicular to the axis direction.

2. The development apparatus according to claim 1, wherein the supply roller has a foam layer and a shaft supporting the foam layer, having a tensile strength greater than a tensile strength of the second sealing member, and the shaft is supported on the same plane by a hole provided in the second sealing member.

3. The development apparatus according to claim 2, wherein the hole passes through the second sealing member, and also the shaft passes through the second sealing member.

4. The development apparatus according to claim 2, wherein the shaft of the supply roller is further supported by a second hole provided at the other end side of the frame member in the axis direction.

5. The process cartridge according to claim 4, wherein the hole passes through the second sealing member, and also the shaft passes through the second sealing member.

6. The development apparatus according to claim 1, wherein the second sealing member is provided from one end to the other end of the through hole in the axis direction.

7. The development apparatus according to claim 1, wherein the second sealing member has a tensile strength of 20 MPa or more.

8. A development apparatus for an image forming apparatus, the development apparatus comprising:

a development roller configured to develop, using a developer, an electrostatic latent image formed on an image bearing body;

a frame member accommodating the developer and having a through hole and a supporting portion at one end side of the frame member in an axis direction of the development roller;

a supply roller configured to supply the developer to the development roller;

a first sealing member provided in the supporting portion and configured to seal a gap between a peripheral surface of the development roller and the frame member at one end side of the frame member in the axis direction to prevent the developer from leaking from the frame member; and a second sealing member configured to seal the through hole, wherein a diameter of the through hole is greater than a maximum outer diameter of the supply roller.

9. The development apparatus according to claim 8, wherein the first sealing member, the supporting portion, and the second sealing member are arranged in this order on the same plane perpendicular to the axis direction.

10. The development apparatus according to claim 8, wherein the second sealing member made of a resin.

11. A process cartridge attachable to and detachable from an apparatus main body of an image forming apparatus, the process cartridge comprising:

an image bearing body;

a development roller configured to develop, using a developer, an electrostatic latent image formed on the image bearing body;

a frame member accommodating the developer and having a through hole and a supporting portion at one end side of the frame member in an axis direction of the development roller;

a supply roller attached to the frame member passing through the through hole and configured to supply the developer to the development roller;

a first sealing member provided in the supporting portion and configured to seal a gap between a peripheral surface of the development roller and the frame member at one end side of the frame member in the axis direction to prevent the developer from leaking from the frame member; and a second sealing member made of a resin and configured to seal the through hole, wherein the first sealing member, the supporting portion, and the second sealing member are arranged in this order on the same plane perpendicular to the axis direction.

12. The process cartridge according to claim 11, wherein the supply roller has a foam layer and a shaft supporting the foam layer, which has a tensile strength greater than a tensile strength of the second sealing member, and is supported on the same plane by a hole provided in the second sealing member.

13. The process cartridge according to claim 12, wherein the shaft of the supply roller is further supported by a second hole provided at the other end side of the frame member in the axis direction.

14. The process cartridge according to claim 11, wherein the second sealing member is provided from one end to the other end of the through hole in the axis direction.

15. The process cartridge according to claim 11, wherein the second sealing member has a tensile strength of 20 MPa or more.

16. An image forming apparatus for forming an image on a recording medium, the image forming apparatus comprising:

(i) an image bearing body;

(ii) a development apparatus including:

a development roller configured to develop, using a developer, an electrostatic latent image formed on the image bearing body;

a frame member accommodating the developer and having a through hole and a supporting portion at one end side of the frame member in an axis direction of the development roller;

a supply roller attached to the frame member passing through the through hole and configured to supply the developer to the development roller;

a first sealing member provided in the supporting portion and configured to seal a gap between a peripheral surface of the development roller and the frame member at one end side of the frame member in the axis direction to prevent the developer from leaking from the frame member; and a second sealing member made of a resin and configured to seal the through hole, wherein the first sealing member, the supporting portion, and the second sealing member are arranged in this order on the same plane perpendicular to the axis direction.

17. An image forming apparatus for forming an image on a recording medium, the image forming apparatus comprising:

(i) a process cartridge detachably mounted on an apparatus main body of the image forming apparatus, the process cartridge including:

an image bearing body;

a development roller configured to develop, using a developer, an electrostatic latent image formed on the image bearing body;

a frame member accommodating the developer and having a through hole and a supporting portion at one end side of the frame member in an axis direction of the development roller;

a supply roller attached to the frame member passing through the through hole and configured to supply the developer to the development roller;

a first sealing member provided in the supporting portion and configured to seal a gap between a peripheral surface of the development roller and the frame member at one end side of the frame member in the axis direction to prevent the developer from leaking from the frame member; and a second sealing member made of a resin and configured to seal the through hole, wherein the first sealing member, the supporting portion, and the second sealing member are arranged in this order on the same plane perpendicular to the axis direction; and (ii) a conveyance unit configured to convey the recording medium.

18. A process cartridge attachable to and detachable from an apparatus main body of an image forming apparatus, the process cartridge comprising:

an image bearing body;

a development roller configured to develop, using a developer, an electrostatic latent image formed on the image bearing body;

a frame member accommodating the developer and having a through hole and a supporting portion at one end side of the frame member in an axis direction of the development roller;

a supply roller configured to supply the developer to the development roller;

a first sealing member provided in the supporting portion and configured to seal a gap between a peripheral surface of the development roller and the frame member at one end side of the frame member in the axis direction to prevent the developer from leaking from the frame member; and a second sealing member configured to seal the through hole, wherein a diameter of the through hole is greater than a maximum outer diameter of the supply roller.

19. The process cartridge according to claim 18, wherein the first sealing member, the supporting portion, and the second sealing member are arranged in this order on the same plane perpendicular to the axis direction.

20. The process cartridge according to claim 18, wherein the second sealing member made of a resin.

21. An image forming apparatus for forming an image on a recording medium, the image forming apparatus comprising:

(i) an image bearing body; and (ii) a development apparatus including:

a development roller configured to develop, using a developer, an electrostatic latent image formed on the image bearing body;

a frame member accommodating the developer and having a through hole and a supporting portion at one end side of the frame member in an axis direction of the development roller;

a supply roller configured to supply the developer to the development roller;

a first sealing member provided in the supporting portion and configured to seal a gap between a peripheral surface of the development roller and the frame member at one end side of the frame member in the axis direction to prevent the developer from leaking from the frame member; and a second sealing member configured to seal the through hole, wherein a diameter of the through hole is greater than a maximum outer diameter of the supply roller.

22. The image forming apparatus according to claim 21, wherein the first sealing member, the supporting portion, and the second sealing member are arranged in this order on the same plane perpendicular to the axis direction.

23. The image forming apparatus according to claim 21, wherein the second sealing member made of a resin.

24. An image forming apparatus for forming an image on a recording medium, the image forming apparatus comprising:

(i) a process cartridge detachably mounted on an apparatus main body of the image forming apparatus, the process cartridge including:

an image bearing body;

a development roller configured to develop, using a developer, an electrostatic latent image formed on the image bearing body;

a frame member accommodating the developer and having a through hole and a supporting portion at one end side of the frame member in an axis direction of the development roller;

a supply roller configured to supply the developer to the development roller;

a first sealing member provided in the supporting portion and configured to seal a gap between a peripheral surface of the development roller and the frame member at one end side of the frame member in the axis direction to prevent the developer from leaking from the frame member; and a second sealing member configured to seal the through hole, wherein a diameter of the through hole is greater than a maximum outer diameter of the supply roller; and (ii) a conveyance unit configured to convey the recording medium.

25. The image forming apparatus according to claim 24, wherein the first sealing member, the supporting portion, and the second sealing member are arranged in this order on the same plane perpendicular to the axis direction.

26. The image forming apparatus according to claim 24, wherein the second sealing member made of a resin.

27. A development apparatus for an image forming apparatus, the development apparatus comprising:

a development roller configured to develop, using a developer, an electrostatic latent image formed on an image bearing body;

a frame member accommodating the developer and having a through hole and a supporting portion at one end side of the frame member in an axis direction of the development roller;

a supply roller configured to supply the developer to the development roller;

a first sealing member provided in the supporting portion and configured to seal a gap between a peripheral surface of the development roller and the frame member at one end side of the frame member in the axis direction to prevent the developer from leaking from the frame member; and a second sealing member configured to seal the through hole, wherein a cross section of the through hole perpendicular to the supply roller axis is greater than a cross section with the maximum outer diameter of the supply roller perpendicular to the supply roller axis to allow the insertion of the supply roller into the through hole in the direction of the supply roller axis.

28. The development apparatus according to claim 27, wherein the first sealing member, the supporting portion, and the second sealing member are arranged in this order on the same plane perpendicular to the axis direction.

29. The development apparatus according to claim 27, wherein the second sealing member made of a resin.

30. A process cartridge attachable to and detachable from an apparatus main body of an image forming apparatus, the process cartridge comprising:

an image bearing body;

a development roller configured to develop, using a developer, an electrostatic latent image formed on the image bearing body;

a frame member accommodating the developer and having a through hole and a supporting portion at one end side of the frame member in an axis direction of the development roller;

a supply roller configured to supply the developer to the development roller;

a first sealing member provided in the supporting portion and configured to seal a gap between a peripheral surface of the development roller and the frame member at one end side of the frame member in the axis direction to prevent the developer from leaking from the frame member; and a second sealing member configured to seal the through hole, wherein a cross section of the through hole perpendicular to the supply roller axis is greater than a cross section with the maximum outer diameter of the supply roller perpendicular to the supply roller axis to allow the insertion of the supply roller into the through hole in the direction of the supply roller axis.

31. The process cartridge according to claim 30, wherein the first sealing member, the supporting portion, and the second sealing member are arranged in this order on the same plane perpendicular to the axis direction.

32. The process cartridge according to claim 30, wherein the second sealing member made of a resin.

33. An image forming apparatus for forming an image on a recording medium, the image forming apparatus comprising:

(i) an image bearing body; and (ii) a development apparatus including:

a development roller configured to develop, using a developer, an electrostatic latent image formed on the image bearing body;

a frame member accommodating the developer and having a through hole and a supporting portion at one end side of the frame member in an axis direction of the development roller;

a supply roller configured to supply the developer to the development roller;

a first sealing member provided in the supporting portion and configured to seal a gap between a peripheral surface of the development roller and the frame member at one end side of the frame member in the axis direction to prevent the developer from leaking from the frame member; and a second sealing member configured to seal the through hole, wherein a cross section of the through hole perpendicular to the supply roller axis is greater than a cross section with the maximum outer diameter of the supply roller perpendicular to the supply roller axis to allow the insertion of the supply roller into the through hole in the direction of the supply roller axis.

34. The image forming apparatus according to claim 33, wherein the first sealing member, the supporting portion, and the second sealing member are arranged in this order on the same plane perpendicular to the axis direction.

35. The image forming apparatus according to claim 33, wherein the second sealing member made of a resin.

36. An image forming apparatus for forming an image on a recording medium, the image forming apparatus comprising:

(i) a process cartridge detachably mounted on an apparatus main body of the image forming apparatus, the process cartridge including:

an image bearing body;

a development roller configured to develop, using a developer, an electrostatic latent image formed on the image bearing body;

a frame member accommodating the developer and having a through hole and a supporting portion at one end side of the frame member in an axis direction of the development roller;

a supply roller configured to supply the developer to the development roller;

a first sealing member provided in the supporting portion and configured to seal a gap between a peripheral surface of the development roller and the frame member at one end side of the frame member in the axis direction to prevent the developer from leaking from the frame member; and a second sealing member configured to seal the through hole, wherein a cross section of the through hole perpendicular to the supply roller axis is greater than a cross section with the maximum outer diameter of the supply roller perpendicular to the supply roller axis to allow the insertion of the supply roller into the through hole in the direction of the supply roller axis; and (ii) a conveyance unit configured to convey the recording medium.

37. The image forming apparatus according to claim 36, wherein the first sealing member, the supporting portion, and the second sealing member are arranged in this order on the same plane perpendicular to the axis direction.

38. The image forming apparatus according to claim 36, wherein the second sealing member made of a resin.

* * * * *